United States Patent [19]

Dick

[11] Patent Number: 5,006,901

[45] Date of Patent: Apr. 9, 1991

[54] ELECTROMAGNET WITH PLUNGER

[75] Inventor: Heinrich Dick, Nattheim, Fed. Rep. of Germany

[73] Assignee: J. M. Voith GmbH, Heidenheim, Fed. Rep. of Germany

[21] Appl. No.: 479,623

[22] Filed: Feb. 14, 1990

[30] Foreign Application Priority Data

Feb. 18, 1989 [DE] Fed. Rep. of Germany ..... 3905023

[51] Int. Cl.[5] ..... H01F 7/08

[52] U.S. Cl. ..... 335/258; 335/17; 335/281

[58] Field of Search ..... 335/17, 258, 262, 281

[56] References Cited

U.S. PATENT DOCUMENTS 4,004,258 1/1977 Arnold ..... 335/17
4,056,816 11/1977 Guim ..... 335/17 X

FOREIGN PATENT DOCUMENTS 2720877 of 1978 Fed. Rep. of Germany .
3605216 of 1987 Fed. Rep. of Germany .

OTHER PUBLICATIONS

Patent Abstracts of Japan, E-592, Mar. 23, 1988, vol. 12/No. 89.

*Primary Examiner*—George Harris
*Attorney, Agent, or Firm*—Jeffers, Hoffman & Niewyk

[57] ABSTRACT

An electromagnet and plunger assembly including a ring-shaped solenoid coil having a fixed pole component which extends from the one end into the interior of the solenoid coil. Movable in the axial direction, the plunger extends from the other end into the interior of the solenoid coil. A control device serving the adjustment of the armature pull comprises a sensor element measuring the magnetic induction. The pole component is subdivided in two pole parts which are coaxially nested and between which an annular gap is formed. The annular gap is sealed with a magnetically nonconductive material on its end facing toward the plunger. The sensor element is located in the annular gap in the interior of the solenoid coil.

12 Claims, 1 Drawing Sheet

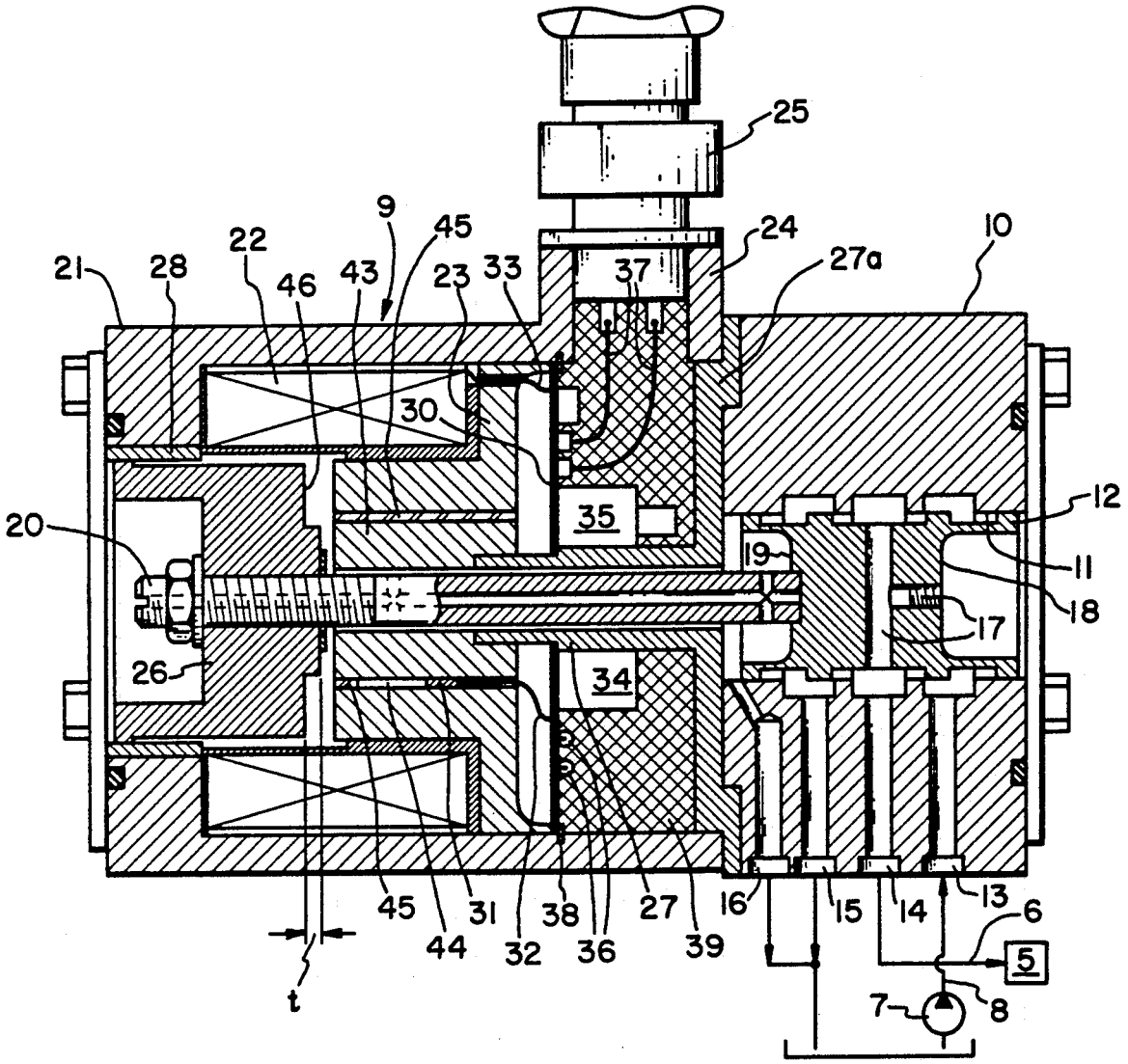
25
9
45
24
10
22
27a
21
28
46
43
23
33
37
30
12
20
35
19
11
18
17
26
34
45
31
38
27
16
15
14
13
6
44
32
36
39
5
t
7
8

ELECTROMAGNET WITH PLUNGER

BACKGROUND OF THE INVENTION

The invention concerns an electromagnet with a plunger. An electromagnet of this type is known from the German Patent No. 27 20 877 (GB 1571769) and serves preferably as the control of a hydraulic pressure control valve. The control device of the prior art, as well as of the electromagnet of the present invention serves the automatic adaptation of the magnetic force to a set value. The adaptation is to occur independently from the travel, i.e., of the position of the plunger within its stroke length. To that end, a measured value representing the current magnetic induction is transmitted to the control device, the measurement being performed by the sensor mentioned in the preamble of claim 1. The measured value and the set value are compared with each other in the control device; in case of a variation between the measured value and the set value, the control device automatically triggers a change of the excitation current, in such a way that the measured value will approach the set value.

In the prior electromagnet, the sensor element is arranged in the working air gap, that is, between the movable plunger and the fixed pole component. The advantage of this arrangement is constituted by the fact that the active area of the sensor element (which preferably is fashioned by a Hall generator) will be passed by the magnetic flow perpendicularly. The active area of the sensor element is the plane in which the charge carriers move, and this plane is located parallel to the working gap. Under these conditions, the induction measured in the gap has an optimum correlation to the magnetic force. Therefore, this prior arrangement of the sensor element provides optimum prerequisites for enabling the said control device to fulfill the purpose described above. However, a disadvantage of the prior arrangement of the sensor element is that it is located at a point where it is mechanically rather vulnerable and where, under certain conditions, it is exposed to an aggressive fluid ingressing from the pressure control valve.

An attempt at solving this problem is known from German Patent disclosure 36 05 216. It arranges the sensor element sideways and outside the interior space enveloped by the solenoid coil, and at that, in the area of that end face of the coil from which the plunger extends into the interior of the coil. The sensor element is located there in an area which is sealed against fluid access. However, this arrangement of the sensor element is associated with the disadvantage that not only the useful magnetic flux relevant for the onset of the magnetic force is measured but also a so-called stray flux, the magnitude of which depends on the current width of the air gap. Said stray flux decreases with a reduction of the air gap. Once the control device goes into action, this causes an undesirable contingency of the magnetic flux (and thus of the magnetic force) on the width of the air gap between the plunger and pole component.

Therefore, the problem underlying the invention is to improve the electromagnet known from the German Patent document 27 20 877 to the effect that the sensor element can be accommodated at a location which is safer than heretofore, and at that, without losing the previous advantage that the magnetic flux (and thereby the magnetic force) can be measured with high accuracy. Specifically sought is the avoidance of an adulteration of the measuring result by a so-called stray flux.

In other words, according to the invention, an annular gap subdivides the pole component in two pole component parts which essentially lie coaxially with one another and are magnetically insulated from each other. As a result, a rather exactly radial direction of the magnetic flux results in the annular gap, which now accommodates the sensor element. The latter is so inserted in the annular gap that its active surface lies parallel to the annular gap. As a result, the active surface of the sensor, in turn, is passed perpendicularly by the magnetic flux.

Furthermore, the sensor element (compared to the German Patent Disclosure 36 05 216) lies no longer in the area of that end of the solenoid coil from which the plunger extends into the interior of the coil. Instead, the sensor element now is located in the area of the opposite end of the solenoid coil, i.e., where the fixed pole component extends into the interior of the solenoid coil. All of these measures cause the sensor element (which preferably is fashioned as a Hall generator) to be passed exclusively (or nearly exclusively) by the useful magnetic flux, i.e., by the flux passing through the plunger. Thus, the sensor element is at least extensively free of interfering stray flux. At the same time, in contrast to the German Patent Document 27 20 877, it is located at an extremely well protected point. The risk of injury to the sensor element is now nearly zero. Moreover, the arrangement offers the advantage that the magnetic resistance of the annular gap (which accommodates the sensor element) remains relatively small, due to the rather large cylindrical surface of the annular gap.

Additionally, the sensor element can now be protected from fluids, specifically aggressive fluids. For that purpose, the annular gap will be sealed at the end of the pole component that faces toward the plunger with a nonmagnetic material. This is especially important when the solenoid is used to control a hydraulic pressure control valve and, thus, is installed directly on it.

The annular gap may have various shapes, for instance conical and/or with a shoulder. The cylindrical shape is preferred in order to simplify the manufacture. The clearance of the annular gap can vary across the length of the solenoid but is preferably made constant.

The effect described above, namely measuring on the sensor element the flux passing through the plunger, can be further improved by making the magnetic resistance in the fixed pole component on both sides of the annular gap at least approximately identical, provided the air gap (i.e., the distance between the plunger and the pole component) assumes a minimum value. This adaptation of the magnetic resistance in the two areas of the pole component can be effected in an especially simple way by providing in the plunger a ring-shaped recess in the end face facing toward the fixed pole component. The depth of the recess can be determined by trial or by computation. What can be accomplished thereby is that the magnetic force will be entirely independent of travel. Or, if desired, a specific contingency on travel of the magnetic force can be accomplished.

The above control and the pertaining components are preferably arranged (as known from the German Patent Document 27 20 877) between the outer end face of the pole component and the device to be controlled (for instance the pressure control valve) in a so-called electronic space. The annular space is suitably open toward the electronic space, at least where the sensor element is arranged. This greatly facilitates the assembly of the sensor element and of the pertaining electric lines.

An embodiment of the invention will be explained hereafter with the aid of the drawing. The latter shows a longitudinal section of a solenoid controlling a pressure control valve.

The illustrated electrically controlled pressure control valve serves the conversion of an electrical signal amplitude, a control variable, to an analog hydraulic variable. It is thus an electrohydraulic signal converter.

The unit comprises a valve housing 10 with a central bore 11 for a valve piston 12, additionally an inlet 13, outlet 14, drain 15 and leakage oil drain 16.

As diagrammatically illustrated, the inlet 13 may be connected with a pressure line 8 of a pump 7 while to the outlet 14 a line 6 may be connected that feeds the controlled pressure, i.e., the hydraulic output variable, to a load 5. The outlet 14 communicates by way of bores 17 with the one end side 18 of the piston 12. Attached to the opposite end face 19 is an adjustment rod 20 which forms the actuator of a solenoid, which in its entirety is marked 9.

The solenoid comprises essentially a magnet housing 21, a coil 22, a movable plunger 26 and a fixed, 2-part pole component 23, 43. The latter consists of an outer pole component 23 and an inner part 43. Both pole parts 23 and 43 are preferably of a rotationally symmetric shape and arranged coaxially to one another as well as to the plunger 6 and the solenoid coil 22. Contained between the 2-pole component parts 23 and 43 is a magnetic insulation and a preferably cylindrical annular gap 44 in which a sensor element fashioned as a Hall generator is contained. The annular gap is extensively filled with a magnetically nonconductive material 45. Used for that purpose, e.g., are either brass, silver solder or the like. The 2-pole components parts 23, 43 form thus mechanically a unit. The annular gap 44 is open only in the area of the Hall generator 31 on the right end as viewed in the drawing.

Shown also is a connection socket 24 for an electrical connector 25 serving to feed an electrical control variable and to supply energy. The actuator rod 20 is screwed into the movable plunger 26. On the left end of the magnet housing 21, the plunger 26 runs in a sleeve 28.

In the electronic component space 39 contained between the pole component 23, 43 and the valve housing 10, a printed circuit board 30 for a control device is attached to the pole component 23, 43. The control device serves to keep the magnetic force at a constant value which is preset by the control variable (set value), the magnetic force (or "armature pull") being independent of the position of the plunger 26 within the distance of the armature stroke. The magnetic induction measured by the said Hall generator 31 serves as a control or measuring variable. The hall generator 31 arranged in the annular gap 44 connects the printed circuit board 30 by way of four lines, two measuring lines and two control current lines. Only one of these four lines is indicated at 32. The armature pull is adjusted by variation of the excitation current flowing by way of the line 33 through the solenoid coil 22.

The electronic components of the control device that are arranged on the printed circuit board 30 are indicated in the drawing, for instance 34, 35 and 36. The lines running from the plug connection 25 to the printed circuit board 30 are marked 37. The solenoid coil 22, pole component 23, 43 and the printed circuit board 30 are fixed in axial direction by a retaining ring 38. The printed circuit board 30 is a circular disk through the center of which extend the actuator rod 20 and a sleeve 27 which in sealing fashion protrudes into the pole component interior 43. The sleeve 27 is connected with an intermediate disk **27*a* that rests between the valve housing 21, sealing the annular gap 44 and the electronic space 39 toward the interior of the valve. Additionally, the electronic component space 39** may be filled with a plastic casting compound.

The plunger 26 features on its end face toward the pole component 23, 43 a shoulder 46 with a depth t.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and falls within the limits of the appended claims.

What is claimed is:

1. An electromagnet and plunger assembly comprising:

a plunger, a fixed essentially ring-shaped solenoid coil, a fixed pole component extending from one end of said coil into the interior of said coil, said plunger being movable in an axial direction and extending from the other end of said coil into the interior of said coil, a control means for adjusting armature pull comprising a sensor means for measuring magnetic flux and thus magnetic induction, and an annular gap coaxial with said electromagnet which extends through said fixed pole component so that said pole component is subdivided into parts that are magnetically insulated from each other, said sensor means being located in the annular gap between said two pole component parts.

2. The electromagnet and plunger assembly of claim 1 wherein the annular gap is sealed with a magnetically nonconductive material on an end thereof facing toward said plunger.

3. The electromagnet and plunger assembly of claim 2 wherein the annular gap is cylindrical.

4. The electromagnet and plunger assembly of claim 1 wherein the annular gap is cylindrical.

5. The electromagnet and plunger assembly of claim 4 wherein said plunger includes on an end thereof facing toward said fixed pole component a ring-shaped recess forming a shoulder, the depth of the recess being so dimensioned that the magnetic resistance in said fixed pole component on both ends of the annular gap is approximately equal when an air gap between said plunger and said pole component assumes a minimum value.

6. The electromagnet and plunger assembly of claim 3 wherein said plunger includes on an end thereof facing toward said fixed pole component a ring-shaped recess forming a shoulder, the depth of the recess being so dimensioned that the magnetic resistance in said fixed pole component on both ends of the annular gap is approximately equal when an air gap between said plunger and said pole component assumes a minimum value.

7. The electromagnet and plunger assembly of claim 2 wherein said plunger includes on an end thereof facing toward said fixed pole component a ring-shaped recess forming a shoulder, the depth of the recess being so dimensioned that the magnetic resistance in said fixed pole component on both ends of the annular gap is approximately equal when an air gap between said plunger and said pole component assumes a minimum value.

8. The electromagnet and plunger assembly of claim 1 wherein said plunger includes on an end thereof facing toward said fixed pole component a ring-shaped recess forming a shoulder, the depth of the recess being so dimensioned that the magnetic resistance in said fixed pole component on both ends of the annular gap is approximately equal when an air gap between said plunger and said pole component assumes a minimum value.

9. The electromagnet and plunger assembly of claim 8 in combination with a device to be controlled by said electromagnet and plunger wherein said control means is disposed between an outer end of said pole component and said device to be controlled and is disposed in an electronic component space, and wherein the annular gap is open at least in the area of said sensor means facing toward said electronic component space.

10. The electromagnet and plunger assembly of claim 7 in combination with a device to be controlled by said electromagnet and plunger wherein said control means is disposed between and outer end of said pole component and said device to be controlled and is disposed in an electronic component space, and wherein the annular gap is open at least in the area of said sensor means facing toward said electronic component space.

11. The electromagnet and plunger assembly of claim 5 in combination with a device to be controlled by said electromagnet and plunger wherein said control means is disposed between and outer end of said pole component and said device to be controlled and is disposed in an electronic component space, and wherein the annular gap is open at least in the area of said sensor means facing toward said electronic component space.

12. The electromagnet and plunger assembly of claim 2 in combination with a device to be controlled by said electromagnet and plunger wherein said control means is disposed between and outer end of said pole component and said device to be controlled and is disposed in an electronic component space, and wherein the annular gap is open at least in the area of said sensor means facing toward said electronic component space.

* * * * *